US010483627B2

(12) United States Patent
Maley et al.

(10) Patent No.: US 10,483,627 B2
(45) Date of Patent: Nov. 19, 2019

(54) WRAP AROUND ANTENNA

(71) Applicant: CommScope Technologies LLC, Hickory, NC (US)

(72) Inventors: Gregory J. Maley, Downers Grove, IL (US); Jonathon C. Veihl, New Lenox, IL (US); Charles J. Buondelmonte, Sachse, TX (US); Edward Bradley, Allen, TX (US)

(73) Assignee: CommScope Technologies LLC, Hickory, NC (US)

( * ) Notice: Subject to any disclaimer, the term of this patent is extended or adjusted under 35 U.S.C. 154(b) by 723 days.

(21) Appl. No.: 14/982,280

(22) Filed: Dec. 29, 2015

(65) Prior Publication Data

US 2016/0365624 A1 Dec. 15, 2016

Related U.S. Application Data

(60) Provisional application No. 62/173,304, filed on Jun. 9, 2015.

(51) Int. Cl.

| | |
|---|---|
| ***H01Q 1/24*** | (2006.01) |
| ***H01Q 1/12*** | (2006.01) |
| ***H01Q 21/20*** | (2006.01) |

(52) U.S. Cl.

CPC ..... *H01Q 1/246* (2013.01); *H01Q 1/1228* (2013.01); *H01Q 21/205* (2013.01)

(58) Field of Classification Search

CPC ..... H01Q 1/246; H01Q 1/1228; H01Q 1/12; H01Q 3/06; H01Q 21/205; H01Q 1/243

See application file for complete search history.

(56) References Cited

U.S. PATENT DOCUMENTS

| | | | | |
|---|---|---|---|---|
| 3,829,864 A * | 8/1974 | Truskanov | ..... | H01Q 21/00 343/833 |
| 5,291,211 A * | 3/1994 | Tropper | ..... | H01Q 21/205 343/700 MS |
| 5,641,141 A | 6/1997 | Goodwin | | |

(Continued)

FOREIGN PATENT DOCUMENTS

| | | |
|---|---|---|
| CN | 1301415 A | 6/2001 |
| CN | 204088553 U | 1/2015 |

(Continued)

OTHER PUBLICATIONS

Notification of Transmittal of the International Search Report and the Written Opinion of the International Searching Authority, or the Declaration Corresponding to PCT/US2015/067849, dated Apr. 29, 2016, 12 pages.

(Continued)

*Primary Examiner* — Dameon E Levi
*Assistant Examiner* — Jennifer F Hu
(74) *Attorney, Agent, or Firm* — Myers Bigel, P.A.

(57) ABSTRACT

Aspects of the present disclosure may be directed to a wrap-around antenna capable of being wrapped around a support structure to provide antenna patterns for a communication system. Such an assembly may be aesthetically pleasing and, because the antenna assembly allows for radiation away from the support structure, scattering effects due to interference from the support structure may be eliminated.

20 Claims, 8 Drawing Sheets

(56) References Cited

U.S. PATENT DOCUMENTS

| | | | | |
|---|---|---|---|---|
| 5,757,324 | A * | 5/1998 | Helms | H01Q 1/42 343/700 MS |
| 5,880,701 | A | 3/1999 | Bhame et al. | |
| 5,995,063 | A * | 11/1999 | Somoza | H01Q 1/246 343/874 |
| 6,111,553 | A * | 8/2000 | Steenbuck | H01Q 1/1207 343/891 |
| 6,173,537 | B1 | 1/2001 | Davidsson et al. | |
| 6,222,502 | B1 | 4/2001 | Falbo et al. | |
| 6,879,291 | B2 * | 4/2005 | Duxbury | H01Q 1/246 343/700 MS |
| 6,999,042 | B2 | 2/2006 | Dearnley et al. | |
| 7,830,045 | B1 * | 11/2010 | Boulger | H01Q 1/246 307/326 |
| 2004/0077379 | A1 | 4/2004 | Smith et al. | |
| 2004/0155819 | A1 | 8/2004 | Martin et al. | |
| 2004/0174317 | A1 * | 9/2004 | Dearnley | H01Q 1/1207 343/890 |
| 2005/0239324 | A1 | 10/2005 | Low et al. | |
| 2006/0219144 | A1 * | 10/2006 | Phelan | B66F 3/06 114/90 |
| 2007/0030208 | A1 | 2/2007 | Linehan | |
| 2010/0295751 | A1 | 11/2010 | Sheers | |
| 2011/0296761 | A1 * | 12/2011 | Wood | E05D 5/04 49/70 |
| 2013/0265197 | A1 | 10/2013 | Jones | |
| 2015/0156642 | A1 * | 6/2015 | Sobczak | H04B 1/40 455/562.1 |
| 2015/0303585 | A1 | 10/2015 | Chistyakov et al. | |

FOREIGN PATENT DOCUMENTS

| | | | |
|---|---|---|---|
| GB | 2427077 | A | 12/2006 |
| WO | 00/01034 | A | 1/2000 |
| WO | 2008095712 | A1 | 8/2008 |

OTHER PUBLICATIONS

Extended European Search Report for corresponding European Application No. 15895140.0-1205, dated Jan. 4, 2019.

Chinese Office Action corresponding to Chinese Application No. 201580080778.0, dated Apr. 24, 2019.

* cited by examiner

WRAP AROUND ANTENNA

CROSS-REFERENCE TO RELATED APPLICATIONS

This application claims the benefit of U.S. Provisional Patent Application No. 62/173,304, filed on Jun. 9, 2015, the entire contents of which are incorporated herein by reference in their entirety.

BACKGROUND

Wireless operators are using more spectrum bands and increasingly more spectrum within each band to accommodate increased subscriber traffic, and for the deployment of new radio access technologies. Macro cell base station antennas serving large areas have been used in an effort to meet these traffic demands. These macro cell base station antennas may typically be deployed on a dedicated tower or building top.

A newer trend involves adding small-cell base station antennas ("small-cell antennas"), which may be particularly useful in urban areas. Small-cell antennas are often installed on pre-existing objects of a city infrastructure. For example, a small-cell antenna may be housed within a cylindrical radome that is either mounted on top of a support structure (e.g., a utility pole) or offset to the side of the support structure. Due to real estate constraints, the top of the support structure is often not available. And mounting the antenna offset to a side of the support structure may not be desirable. For example, antennas offset to the side of the support structure may not be aesthetically pleasing. Moreover, when offset, the antenna may radiate RF signals that may be come in contact with the support structure. Stated differently, the support structure may interfere with some of the radiated RF signals, potentially causing scattering. Consequently, antenna patterns of the antenna may be compromised, negatively affecting the performance of the antenna.

As such, it would be desirable to have an antenna capable of being mounted around a support structure, in which case intended RF signals may radiate away from the support structure.

SUMMARY OF THE DISCLOSURE

Various aspects of the present disclosure may be directed to a base station antenna comprising an antenna assembly. The antenna assembly may comprise a plurality of antenna columns arranged to be connected to form a perimeter about a central region. Each of the plurality of antenna columns may include one or more radiating elements.

BRIEF DESCRIPTION OF THE SEVERAL VIEWS OF THE DRAWINGS

The following detailed description of the disclosure will be better understood when read in conjunction with the appended drawings. For the purpose of illustrating the disclosure, there are shown in the drawings embodiments which are presently preferred. It should be understood, however, that the disclosure is not limited to the precise arrangements and instrumentalities shown.

In the drawings.

DETAILED DESCRIPTION OF VARIOUS EMBODIMENTS

Figure 1B:
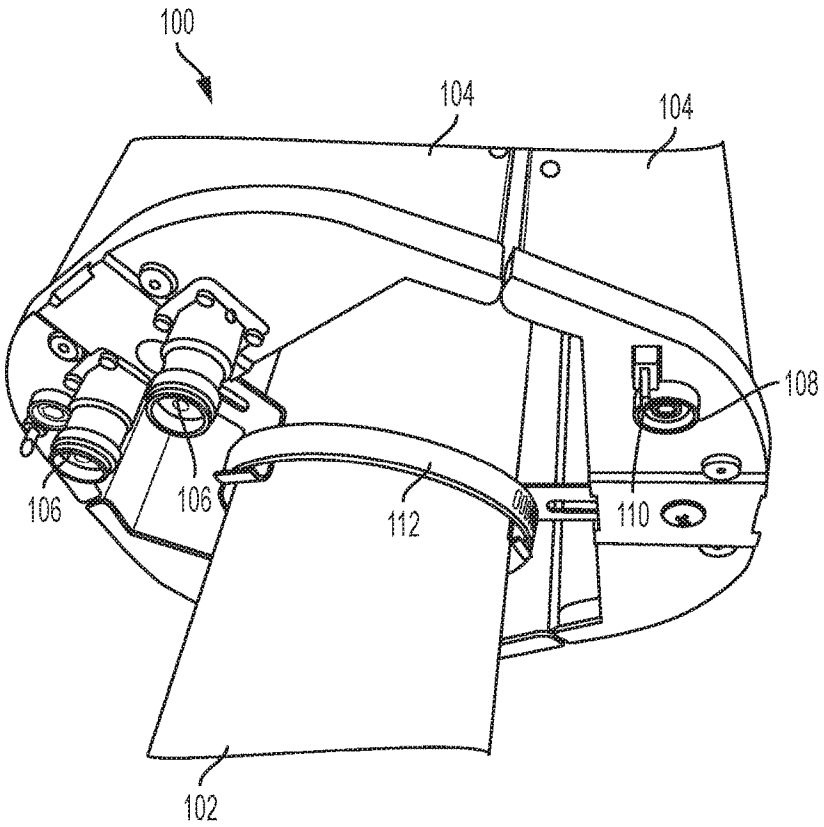
FIG. 1B is a perspective view of an underside of the wrap-around antenna, according to an aspect of the present disclosure.

Certain terminology is used in the following description for convenience only and is not limiting. The words "lower," "bottom," "upper" and "top" designate directions in the drawings to which reference is made. Unless specifically set forth herein, the terms "a," "an" and "the" are not limited to one element, but instead should be read as meaning "at least one." The terminology includes the words noted above, derivatives thereof and words of similar import. It should also be understood that the terms "about," "approximately," "generally," "substantially" and like terms, used herein when referring to a dimension or characteristic of a component of the disclosure, indicate that the described dimension/characteristic is not a strict boundary or parameter and does not exclude minor variations therefrom that are functionally similar. At a minimum, such references that include a numerical parameter would include variations that, using mathematical and industrial principles accepted in the art (e.g., rounding, measurement or other systematic errors, manufacturing tolerances, etc.), would not vary the least significant digit.

Aspects of the present disclosure may be directed to a wrap-around antenna capable of being wrapped around a support structure (e.g., a utility pole) to provide various antenna patterns for a communication system. Such an assembly may be aesthetically pleasing and, because the antenna assembly allows for radiation away from the support structure, scattering effects due to interference from the support structure is eliminated. The wrap-around antenna discussed hereinthroughout may take the form of a macro cell base station antenna or a small cell base station antenna, which generally refers to low-powered base station antennas that may include or be otherwise referred to as femto cells, pico cells, micro cells, and the like.

Figure 1A:
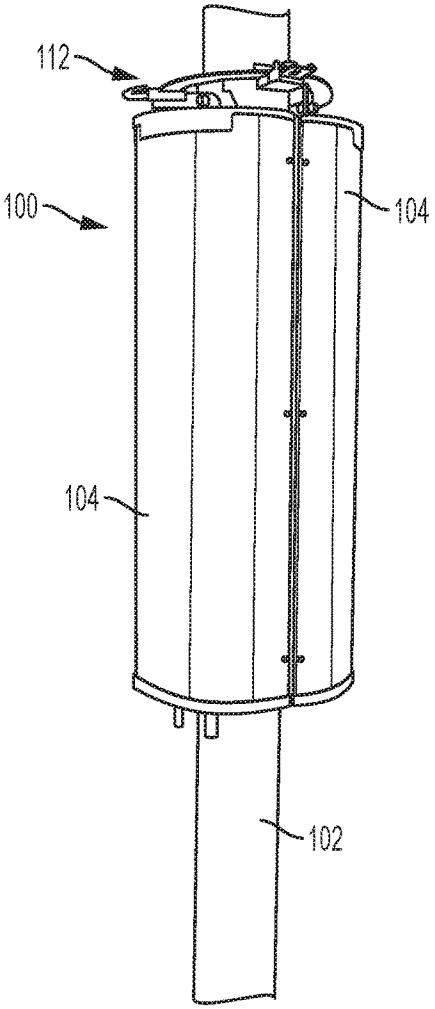
FIG. 1A is a perspective view of a side of a wrap-around antenna encircling a support structure, according to an aspect of the present disclosure.

FIG. 1A is side perspective view of a wrap-around antenna 100 encircling a support structure 102 according to an aspect of the present disclosure. The wrap-around antenna 100 may comprise one or more enclosures 104, such as one or more radomes to seal and protect the antenna components from adverse environmental conditions. Each enclosure 104 may house an antenna column comprising one or more arrays of radiating elements (shown in FIG. 2A) configured to radiate one or more antenna patterns. As shown in a perspective view of one end of the wrap-around antenna 100, an end of one of the antenna columns may include various components including but not limited to radio frequency (RF) connectors 106, downtilt adjuster members 108, and tilt indicators 110. The RF connectors 106 may couple radiating elements of each of the antenna columns to a base station (not shown). Each of the downtilt adjuster members 108 may be configured to allow for adjustment of a tilt of the antenna column to which it is attached. It should be noted that tilt of each of the antenna columns may be adjusted manually, such as via personnel, proximate to the wrap-around antenna 100, or remotely, such as via a motor drive system.

Each of the tilt indicators 110 may be extended longitudinally from the end of the wrap-around antenna 100 and may provide an indication of a degree of tilt of the respective antenna columns. As shown, the wrap-around antenna 100 may be affixed to the support structure via a mounting bracket 112, an internal diameter of which may be adjusted to secure the wrap-around antenna to support structures of various diameters.

Figure 2A:
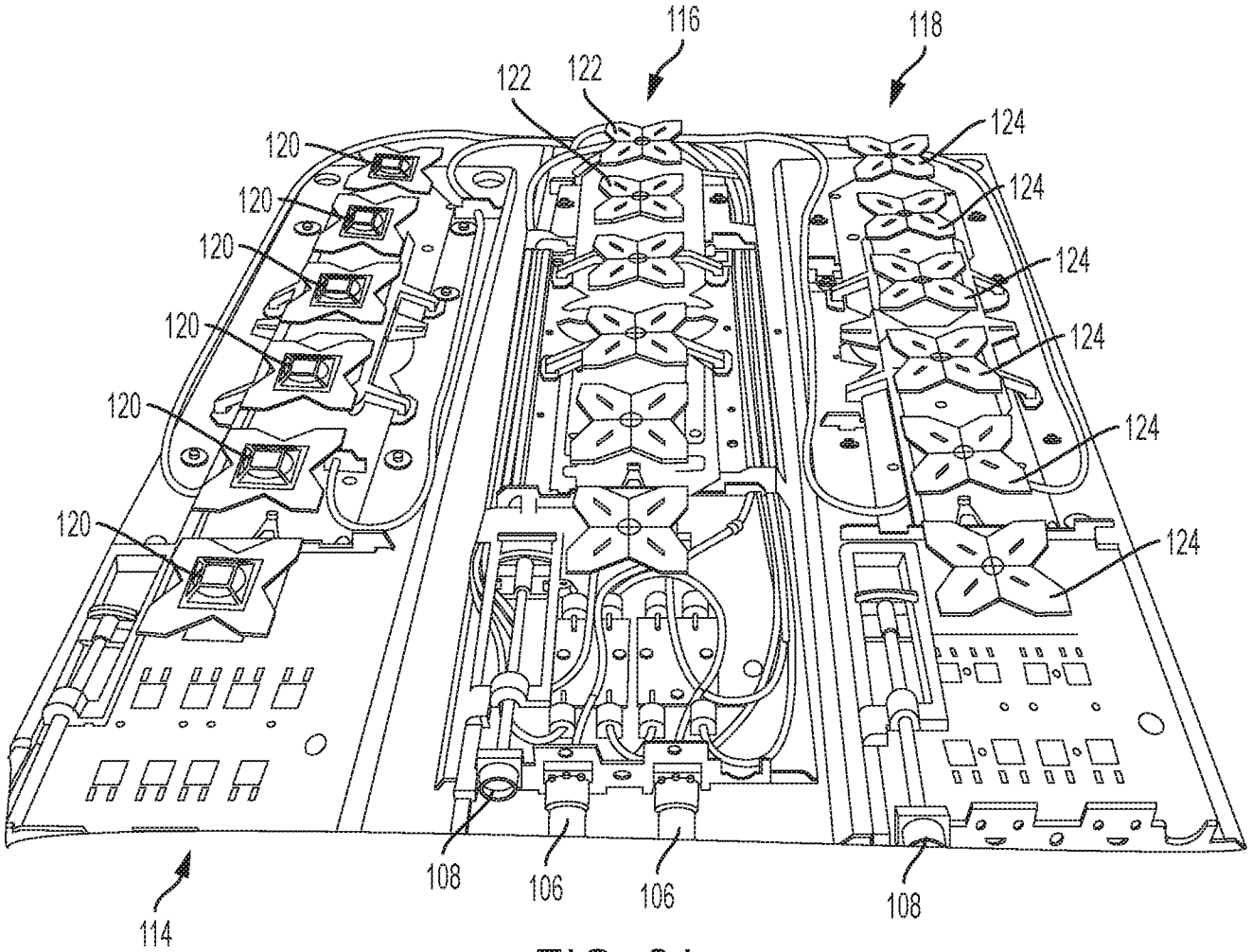
FIG. 2A is a perspective view of an interior of antenna columns of the wrap-around antenna, according to an aspect of the present disclosure.

FIG. 2A is a perspective end view of each of the antenna columns 114, 116, 118 laid flat, or, for example, not yet mounted around a support structure, and without their respective enclosures 104. As shown, the antenna columns 114, 116, 118 may include a plurality of radiating elements 120, 122, 124, respectively, which may be arranged in a linear array dimensioned for transmission and/or reception of RF signals in a desired frequency band. It should be noted that the antenna columns 114, 116, 118 may include respective radiating elements 120, 122, 124 configured to operated in one or more than one frequency band. In other words, each antenna column 114, 116, 118 may be a single-band, dual-band, or multi-band antenna column. Each of the radiating elements 120, 122, 124 may, e.g., comprise crossed dipole elements, which may be oriented so that the dipole elements are at approximately +45 degrees to vertical and −45 degrees to vertical to provide polarization diversity reception. It should be noted, however, that each of the radiating elements may comprise any type of radiating element suitable for use in a wireless communication network configured for personal communication systems (PCS), personal communication networks (PCN), cellular voice communications, specialized mobile radio (SMR) service, enhanced SMR service, wireless local loop and rural telephony, and paging. For example, the individual radiating elements 120, 122, 124 may be also monopole elements, loops, slots, spirals or helices, horns, or microstrip patches. It should also be noted that each antenna column 114, 116, 118 may include any number of radiating elements in keeping with the disclosure.

Figure 2B:
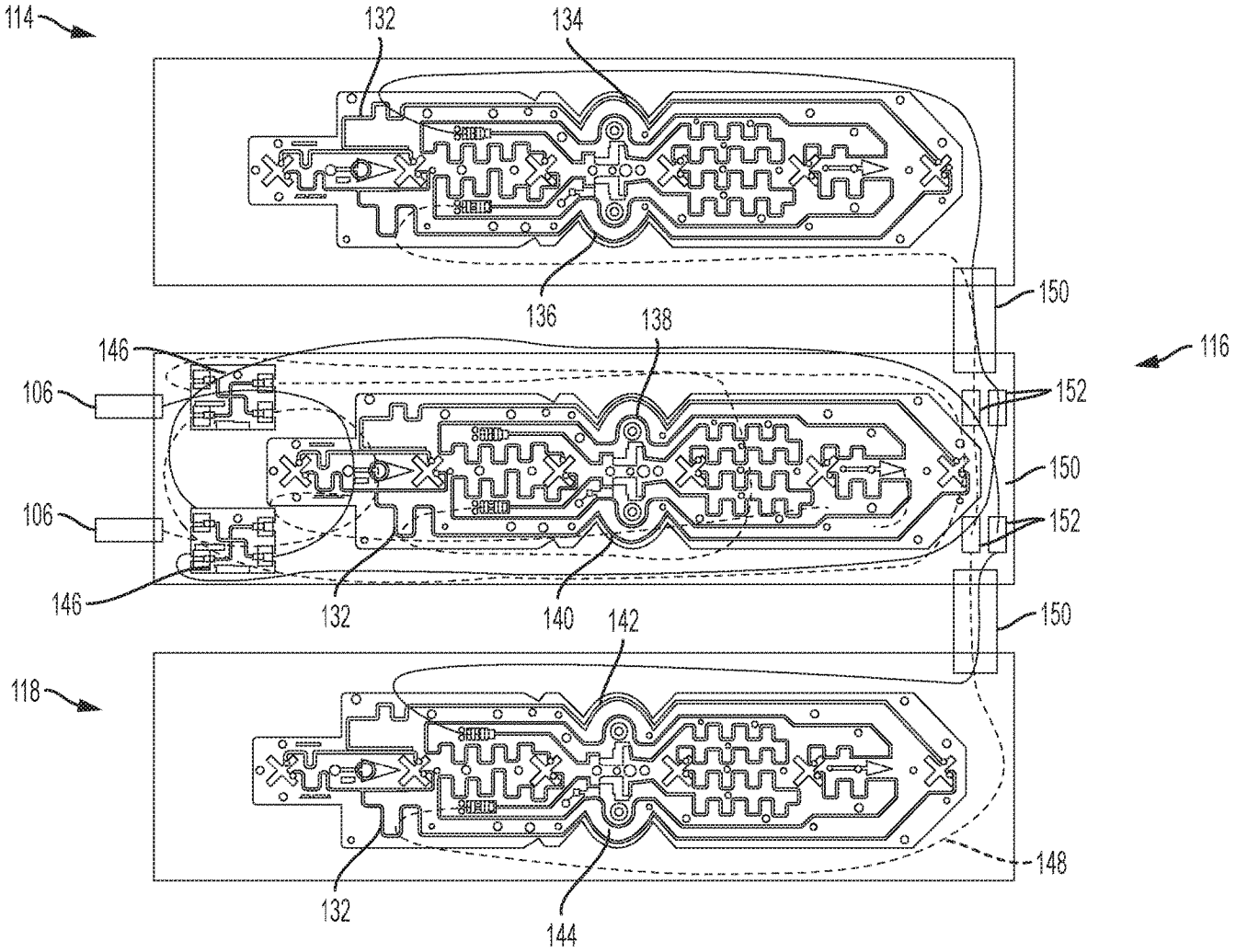
FIG. 2B is a schematic of the antenna columns of the wrap-around antenna according to an aspect of the present disclosure.

FIG. 2B is a plan view of a schematic of a plurality of feed boards 126, 128, 130 of the respective antenna columns 114, 116, 118 of the wrap-around antenna 100. Each feed board 126, 128, 130 may comprise micro strip transmission lines ("conductive traces") 132 for electrically connecting various antenna components, which may include one or more phase shifters. For example, phase shifters 134, 136 may be configured to phase shift RF signals to be transmitted from, and received by, the radiating elements 120 of the antenna column 114. Similarly, the phase shifters 138, 140 may be configured to phase shift RF signals to be transmitted from, and received by, the radiating elements 122 of the antenna column 116; and the phase shifters 142, 144 may be configured to phase shift RF signals to be transmitted from, and received by, the radiating elements 124 of antenna column 118.

Rotatable wiper arms for each of the phase shifters 134, 136, 138, 140, 142, 144 are not illustrated to enhance clarity of the fixed portions of the first and second band phase shifters. Each of the phase shifters may comprise variable differential, arcuate phase shifters as described in U.S. Pat. No. 7,907,096, which is incorporated herein by reference. It should be noted however, that each of the phase shifters 134, 136, 138, 140, 142, 144 may take the form of other types of phase shifters in keeping with the spirit of this disclosure.

As shown, one of the antenna columns, (such as, for example antenna column 116) may include RF connectors 106 to couple the radiating elements 120, 122, 124 of respective antenna columns 114, 116, 118 to the base station. The RF connectors 106 may be coupled to one or more power dividers 146 configured to distribute signals received by the base station and combine signals received from one or more of the antenna columns 114, 116, 118. For example, an RF signal may be transmitted from the base station external to the antenna 100, and, via one or more internal RF cables 148 connected to the RF connectors 106, the signal may be transmitted to one or more of the power dividers 146. The power divider(s) 146 may divide the RF signal into several divided RF signals. Each of the divided RF signals may be transmitted, via one or more cables 148 to the radiating elements 120, 124, 126 of respective antenna columns 114, 116, 118. Alternatively, RF signals may be received from one or more of the radiating elements 120, 124, 126, and received by one or more of the power dividers 146. The one or more power dividers 146 may then combine each of the received RF signals for transmission of the combined RF signal to the base station. The power dividers 146 may also be coupled to one or more diplexers (not shown) configured to allow for the communication of RF signals from different frequency bands. Moreover, it should be noted that the wrap-around antenna 100 may support more than two frequency bands. In such a design, the one or more diplexers may be replaced with one or more triplexers to allow for communication of RF signals in three or more different frequency bands. As discussed hereinthroughout, a power divider may combine signals received from one or more antenna columns. As such, the power divider may include one or more power combiners.

A portion of one or more of the RF cables 148 between the antenna columns 114, 116, 118 may be secured by a conduit 150, ends of which may be connected to a portion of each of the antenna columns 114, 116, 118. One or more of the antenna columns 114, 116, 118 may also include one or more junction boxes 152 concealing portions of the cables 148. The one or more junction boxes 152 may be accessible from a top end of one or more of the antenna columns 114, 116, 118. Even though the junction boxes 152 are shown at the top end of one of the antenna columns 114, 116, 118, it should be noted that the junction boxes 152 may be located anywhere on one or more of the antenna columns 114, 116, 118 in keeping with the spirit of the disclosure.

Figure 3A:
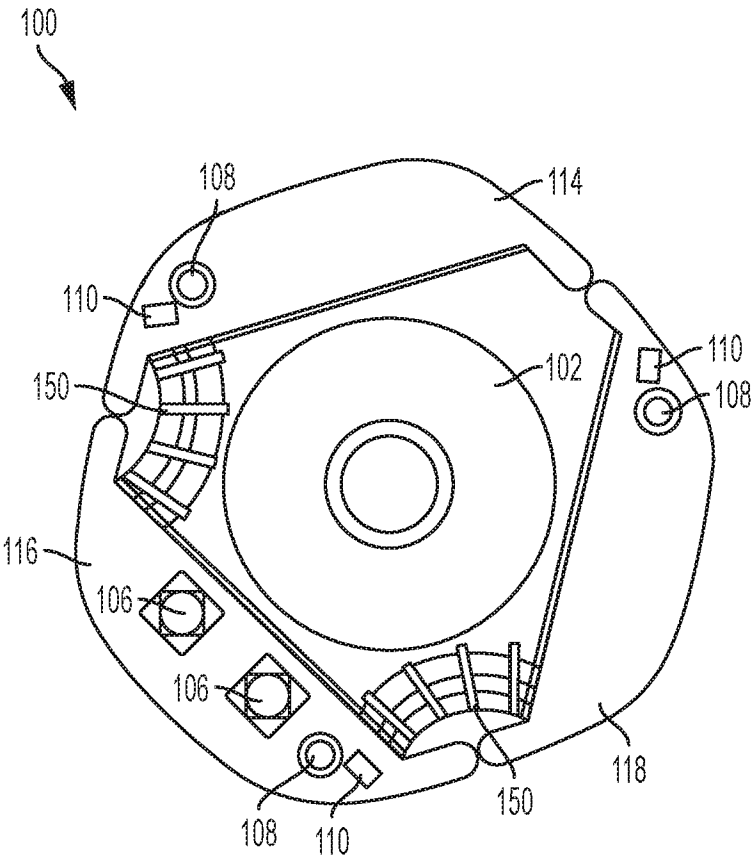
FIG. 3A is an example of an end view of the underside of the wrap-around antenna, according to an aspect of the present disclosure.
Figure 3B:
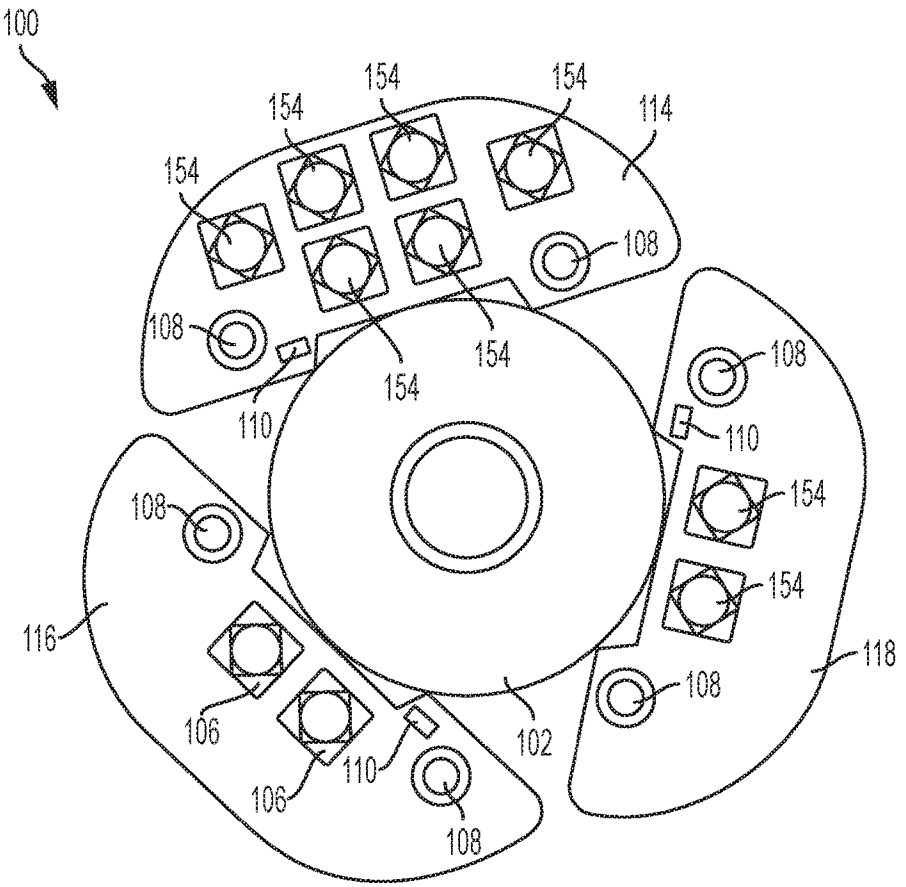
FIG. 3B is another example of an end view of the underside of the wrap-around antenna, according to an aspect of the present disclosure.
Figure 3C:
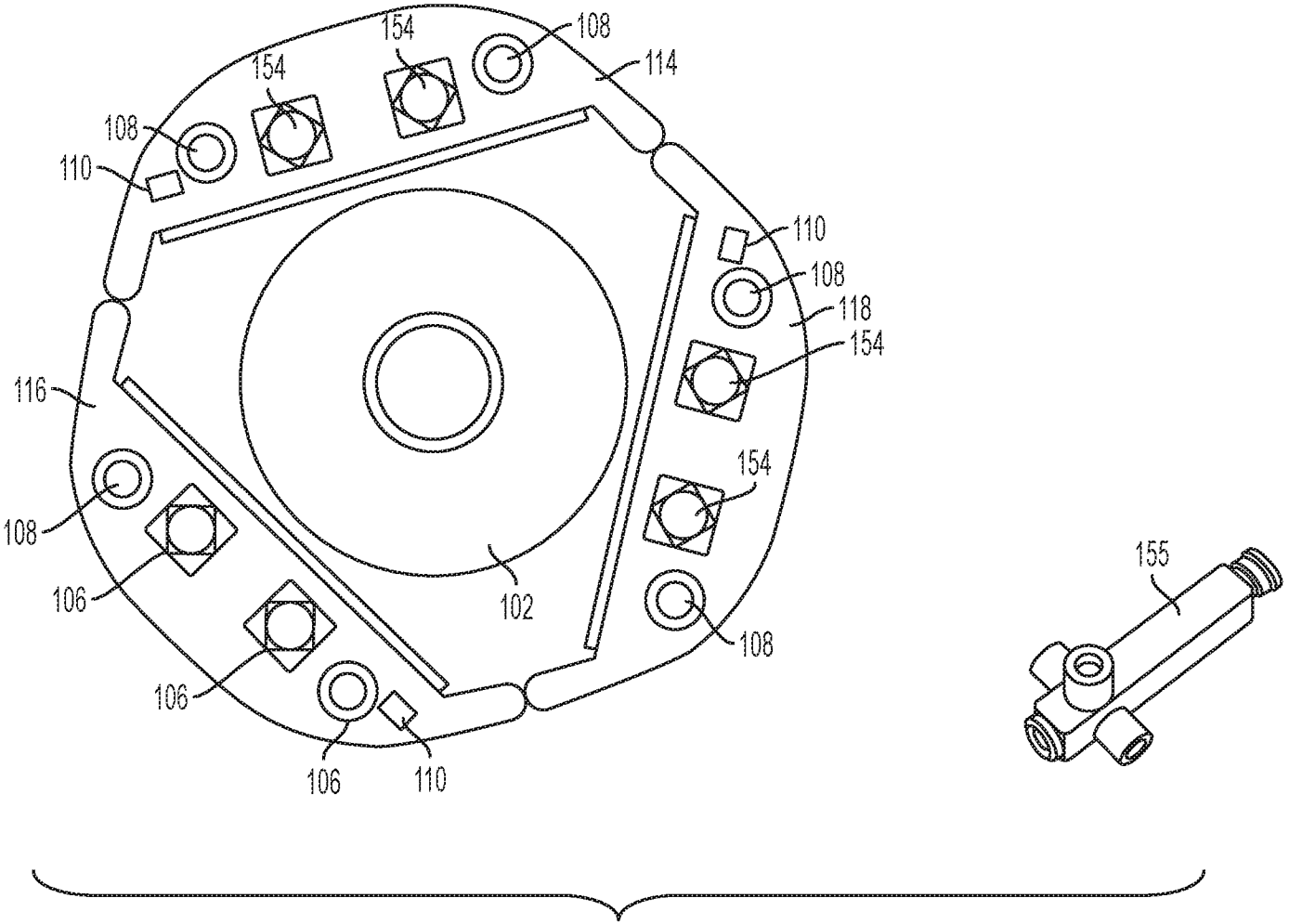
FIG. 3C is yet another example of an end view of the underside of the wrap-around antenna, according to an aspect of the present disclosure.

Aspects of the present disclosure may include various arrangements of antenna components, some examples of which are illustrated in FIGS. 3A-3C. FIG. 3A is an end view of an antenna 100 including inter-connected antenna columns 114, 116, 118 formed around a perimeter (e.g., a circumference) of a support structure 102. Aside from the downtilt adjuster 108 and tilt indicator 110, the antenna column 116 may include only a pair of RF connectors 106.

Further, no RF connectors, power dividers, jumpers, or other components need be located external by (e.g., exposed to an exterior of the respective antenna column 114, 116, 118). Rather, in such an aspect, RF cables 148 may be passed between two of the antenna columns 114, 116, 118 via one or more conduits 150 between two of the antenna columns 114, 116, 118 and the support structure 102.

Another aspect of the present disclosure is illustrated in an end view of the wrap-around antenna 100 in FIG. 3B. Instead of employing conduits 150 for passing RF cables between each of the antenna columns 114, 116, 118, in this aspect, the wrap-around antenna 100 may employ RF jumpers 154 positioned on the exterior of one or more of the antenna columns, 114, 116, 118. The RF jumpers 154 may be configured to connect RF cables from one of the antenna columns 114, 116, 118 to another of the antenna columns 114, 116, 118.

Other implementations may be contemplated by modification of the power division network. For example, three independent sector patterns may be achieved by removal of the power dividers 146 in the interior of the wrap-around antenna 100. For example, as illustrated in FIG. 3C, each of the antenna columns 114, 116, 118 may include one or more RF jumpers 154, and one or more external power dividers 155. Although shown as separate, it is understood that the one or more power dividers (e.g., a 1:3 power divider) 155 may be coupled to one or more of the antenna columns 114, 116, 118, and may be configured to distribute signals received by the base station and combine signals received from one or more of the antenna columns 114, 116, 118. The power dividers 155 and RF jumpers 154 may be covered by a concealment shroud (not shown).

Other implementations of the wrap-around antenna 100 may include only two antenna columns. In such a design, a power divider (for example, a 1:2 power divider) may be configured to distribute signals received by the base station and combine signals received from two antenna columns. With this configuration, the wrap-around antenna may be configured to produce a heart shaped antenna pattern. It should also be noted that the wrap-around antenna 100 may include more than antenna columns as well, in keeping with the spirit of the disclosure.

Figure 4B:
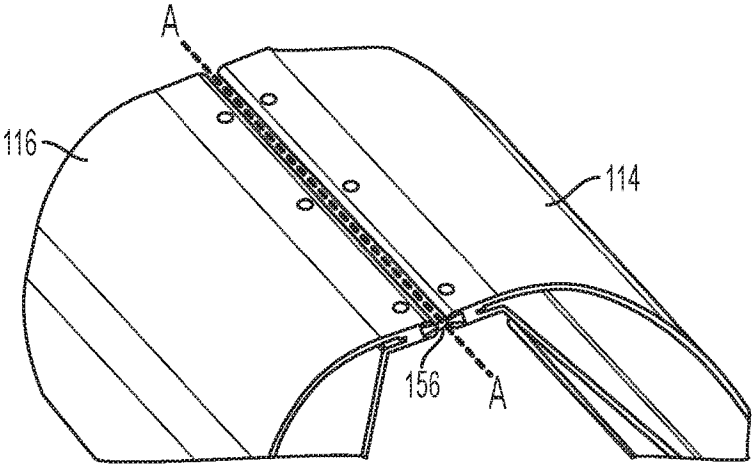
FIGS. 4A and 4B are perspective views of the exterior of the wrap-around antenna, according to an aspect of the present disclosure
Figure 4C:
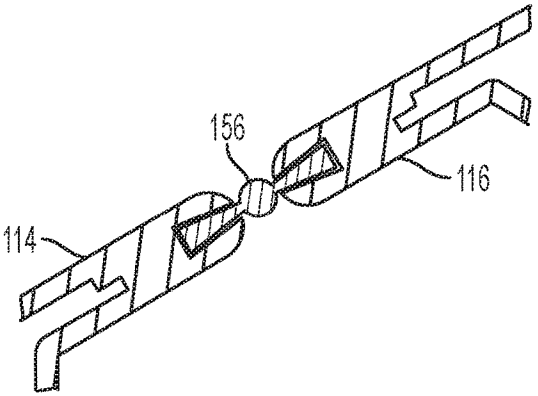
FIG. 4C is an enlarged view of one of the hinges shown in FIGS. 4A and 4B.
Figure 4A:
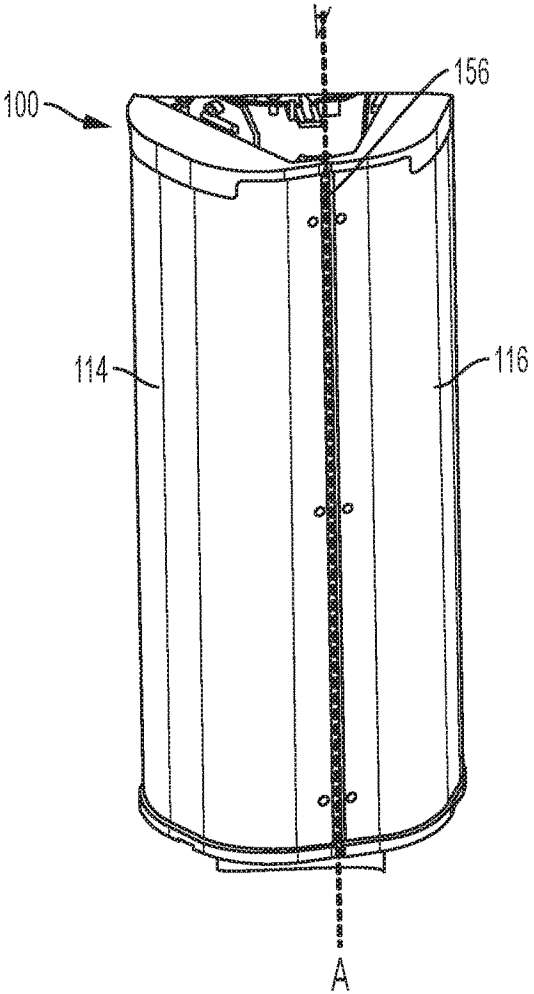

The antenna columns 114, 116, 118 may be physically secured to one another via one or more hinges 156, an example of which is shown in the perspective view of the exterior of the wrap-around antenna 100 in FIGS. 4A and 4B. FIG. 4C is an enlarged view of one of the hinges 156. A lateral end of each of the antenna columns 114, 116 may include an aperture which may run along longitudinal edges of the respective enclosure 104. The aperture may be dimensioned to hold an end of the hinge 156. Accordingly, enclosures 104 of respective antenna columns 114, 116, 118 may be connected by one or more of the hinges 156, and may be pivotable about a central axis A-A of the hinge 156. The pivotable relationship created by the hinge arrangement may facilitate installation of the wrap-around antenna 100 around the support structure 102, instead of having to mount the antenna 100 over the top of the support structure 102.

Figure 5B:
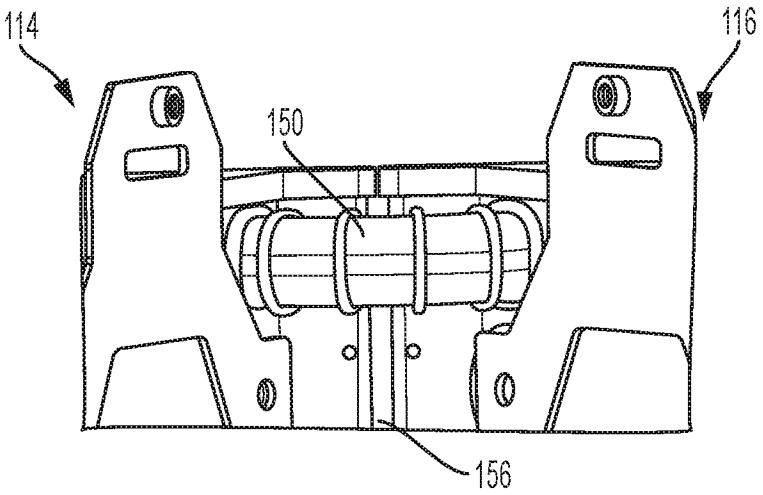
FIGS. 5A and 5B are perspective views of an interior of the wrap-around antenna according to an aspect of the present disclosure.
Figure 5A:
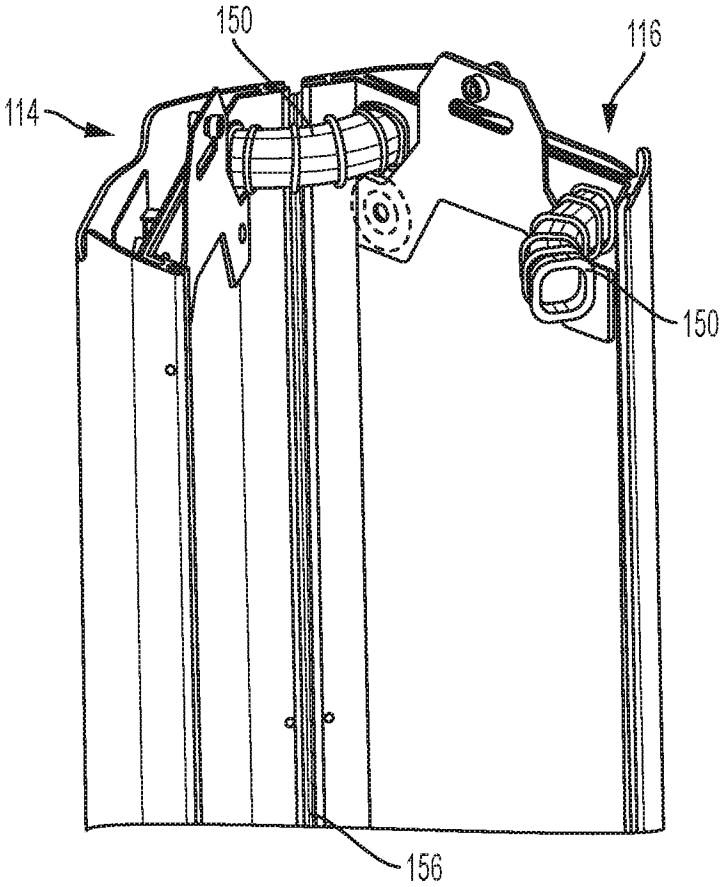

FIG. 5A is a perspective view of an interior portion of two of the antenna columns 114, 116, 118 and FIG. 5B is an enlarged perspective view of the same. Distal ends of the conduits 150 may be secured (e.g., by fasteners, adhesive, and the like) to the interior portion of one or more of the antenna columns 114, 116, 118. The conduits 150 may be made from various types of materials and structures, such as not limited to plastic, metal, and the like. Further, the conduits 150 may be flexible and tubular in nature, and may have various cross sectional shapes.

As discussed above, the conduits 150 may be configured to receive one or more portions of the RF cables 148. The conduits 150 may be configured to guide one or more portions of the RF cables 148 between two of the antenna columns 114, 116, 118. The conduits 150 may also shield the RF cables 148 from exposure to precipitation and prevent potential damage from the same or other external elements.

Various embodiments of the disclosure have now been discussed in detail; however, the disclosure should not be understood as being limited to these embodiments. It should also be appreciated that various modifications, adaptations, and alternative embodiments thereof may be made within the scope and spirit of the present disclosure.

What is claimed is:

1. An antenna comprising:

an antenna assembly comprising a plurality of antenna columns arranged to be connected to form a perimeter about a central region, wherein each of the plurality of inter-connected antenna columns includes one or more radiating elements;

at least one power divider configured to distribute radio frequency (RF) signals received by a base station or combine signals received from at least one of the plurality of inter-connected antenna columns;

a plurality of respective enclosures housing the plurality of antenna columns respectively, wherein the at least one power divider is enclosed within one of the plurality of enclosures, wherein one of the plurality of enclosures is connected to another enclosure of the plurality of enclosures via at least one hinge.

2. The antenna of claim 1, further comprising:

one or more RF connectors configured to couple the plurality of antenna columns to a base station.

3. The antenna of claim 1, wherein the one of the plurality of enclosures and the other enclosure are pivotable about a central axis of the at least one hinge.

4. The antenna of claim 1, wherein at least one of the one or more radiating elements is configured to operate in a first frequency band, and at least one other of the one or more radiating elements is configured to operate in a second frequency band different from the first frequency band.

5. The antenna of claim 1, wherein the plurality of antenna columns comprise three or more inter-connected antenna columns.

6. The antenna of claim 1, wherein the antenna assembly is configured to be mounted around a support structure.

7. The antenna of claim 1, wherein the plurality of antenna columns comprises a total of two antenna columns that are configured to produce a heart shaped antenna pattern.

8. An antenna assembly for a base station antenna configured to radiate one or more quasi-omnidirectional antenna patterns, the antenna assembly comprising:

a plurality of antenna columns configured to be inter-connected in a side-by-side relationship to form a perimeter about a central region, wherein each of the plurality of inter-connected antenna columns includes one or more radiating elements;

a power divider configured to:

distribute signals from a base station to the plurality of inter-connected antenna columns; and combine signals received from each of the plurality of inter-connected antenna columns; and a plurality of respective enclosures configured to enclose the plurality of inter-connected antenna columns, wherein the plurality of enclosures is further configured to enclose the power divider, wherein adjacent enclosures of the plurality of enclosures are configured to be connected by at least one hinge.

9. The antenna assembly of claim 8, wherein the adjacent enclosures are pivotable about a central axis of the at least one hinge.

10. The antenna assembly of claim 8, wherein the antenna assembly comprises three or more antenna columns.

11. The antenna assembly of claim 8, wherein at least one of the inter-connected antenna columns comprises:

one or more first-band radiating elements configured to operate in a first frequency band, and one or more second-band radiating elements configured to operate in a second frequency band.

12. The antenna assembly of claim 8, wherein the antenna assembly is configured to be mounted around a support structure.

13. The antenna assembly of claim 8, further comprising a conduit extending between first and second of the antenna columns, the conduit including an RF cable.

14. An antenna assembly comprising:

a plurality of inter-connected antenna columns configured to be arranged in a side-by-side relationship about a circumference of an upwardly extending portion of an upwardly extending member of a support structure, wherein each of the plurality of inter-connected antenna columns includes one or more radiating elements; and a plurality of respective enclosures configured to enclose the plurality of antenna columns, respectively, wherein a first of the enclosures is configured to pivot with respect to an adjacent second one of the enclosures, and the second one of the enclosures is configured to pivot with respect to an adjacent third one of the enclosures, wherein the antenna columns are physically secured to one another to provide a wrap-around antenna that is configured to wrap around a support structure.

15. The antenna assembly of claim 14, further comprising a power divider that is positioned internal to a first enclosure of the plurality of respective enclosures.

16. The antenna assembly of claim 15, further comprising radio frequency (RF) cables configured to transmit signals from the power divider to each of the antenna columns, wherein at least one of the RF cables is coupled to one of the antenna columns enclosed by a second enclosure of the plurality of respective enclosures, and is coupled to another one of the antenna columns via at least one jumper.

17. The antenna assembly of claim 16, wherein the at least one jumper is external to each of the plurality of respective enclosures.

18. The antenna assembly of claim 15, further comprising RF cables configured to transmit signals from the power divider to each of the antenna columns, wherein at least one of the RF cables is enclosed by a flexible conduit between two of the antenna columns.

19. The antenna assembly of claim 18, wherein the flexible conduit is positioned between the support structure and one or more of the plurality of enclosures.

20. The antenna assembly of claim 15, wherein the power divider is positioned external to the each of the plurality of enclosures, and wherein each of the inter-connected antenna columns is configured to produce independent sectored antenna patterns.

* * * * *